US008555957B2

(12) United States Patent
Shen et al.

(10) Patent No.: US 8,555,957 B2
(45) Date of Patent: Oct. 15, 2013

(54) CRUDE OIL PRODUCTION EQUIPMENT

(75) Inventors: Kuei-Hsien Shen, New Taipei (TW); Chinn-Chann Chiang, New Taipei (TW)

(73) Assignee: Kuei-Hsien Shen, New Taipei (TW)

( * ) Notice: Subject to any disclaimer, the term of this patent is extended or adjusted under 35 U.S.C. 154(b) by 239 days.

(21) Appl. No.: 13/110,952

(22) Filed: May 19, 2011

(65) Prior Publication Data

US 2012/0292011 A1 Nov. 22, 2012

(51) Int. Cl.
*E21B 43/00* (2006.01)

(52) U.S. Cl.
USPC ..... 166/105; 166/369

(58) Field of Classification Search
USPC ..... 166/105, 105.1, 369; 417/54, 56, 58, 417/60, 417
See application file for complete search history.

(56) References Cited

U.S. PATENT DOCUMENTS

2004/0194964 A1* 10/2004 Tieben ..... 166/369
2006/0157257 A1* 7/2006 Ross et al. ..... 166/386
2007/0114015 A1* 5/2007 Shen ..... 166/105
2007/0272406 A1* 11/2007 McCoy et al. ..... 166/250.01

* cited by examiner

*Primary Examiner* — David Bagnell
*Assistant Examiner* — Taras P Bemko
(74) *Attorney, Agent, or Firm* — Muncy, Geissler, Olds & Lowe, PLLC

(57) ABSTRACT

A crude oil production equipment includes a submersible pump coupled with a driving shaft, a linear motor, an oil pipe, a well casing, a filter pipe, an outer passage, an inner tube, an upper valve ball, a piston and a lower valve ball. During down stroke of the driving shaft, a suction force is produced to suck crude oil from the well casing into the upper chamber of the inner and the piston forces crude oil out of the lower chamber of the inner tube into the inner passage and then the outlet of the oil pipe. During up stroke of the driving shaft, the piston forces crude oil out of the upper chamber into the lower chamber, and the driving shaft enters the upper chamber and the lower chamber to force crude oil out of the lower chamber out of the oil outlet of the oil pipe.

2 Claims, 3 Drawing Sheets

CRUDE OIL PRODUCTION EQUIPMENT

BACKGROUND OF THE INVENTION

1. Field of the Invention

The present invention relates to crude oil production technology and more particularly, to crude oil production equipment, which pumps crude oil out of the oil well either during up stroke or down stroke of the linear motor.

2. Description of the Related Art

During crude oil production, a submersible pump is submerged in crude oil in an oil well and operated to pump crude oil out of the oil well. A regular submersible pump uses a rotary motor to move a pumping mechanism. A submersible pump of this design is heavy and expensive, and consumes much electrical power. Thus, the initial investment is quite high. There is known screw type oil production equipment, which uses a spiral propelling device to deliver crude oil. Using screw type oil production equipment requires less investment at the initial stage. However, screw type oil production equipment wears quickly with use. To avoid this problem, a beam pump may be used. A beam pump is durable in use, however it has a complicated structure and needs to use a long oil pipe for delivering crude oil out of the oil well to the ground. Thus, a beam pump has a low performance and a high cost.

Further, during operation of oil production equipment, it is necessary to monitor the temperature of the pumping motor, however, a temperature sensor may be damaged easily when it is used under a high oil pressure environment.

SUMMARY OF THE INVENTION

The present invention has been accomplished under the circumstances in view. It is the main object of the present invention to provide crude oil production equipment, which pumps crude oil out of the oil well either during up stroke or down stroke of the linear motor.

To achieve this and other objects of the present invention, crude oil production equipment consists of a submersible pump coupled with a driving shaft, a linear motor, an oil pipe, a well casing, a filter pipe, an outer passage, an inner tube, an upper valve ball, a piston and a lower valve ball. During down stroke of the driving shaft, a suction force is produced to suck crude oil from the well casing into the upper chamber of the inner tube and the piston forces crude oil out of the lower chamber of the inner tube into the inner passage and then the outlet of the oil pipe. During up stroke of the driving shaft, the piston forces crude oil out of the upper chamber into the lower chamber, and the driving shaft enters the upper chamber and the lower chamber to force crude oil from the lower chamber out through the oil outlet of the oil pipe.

DETAILED DESCRIPTION OF THE PREFERRED EMBODIMENT

Figure 1:
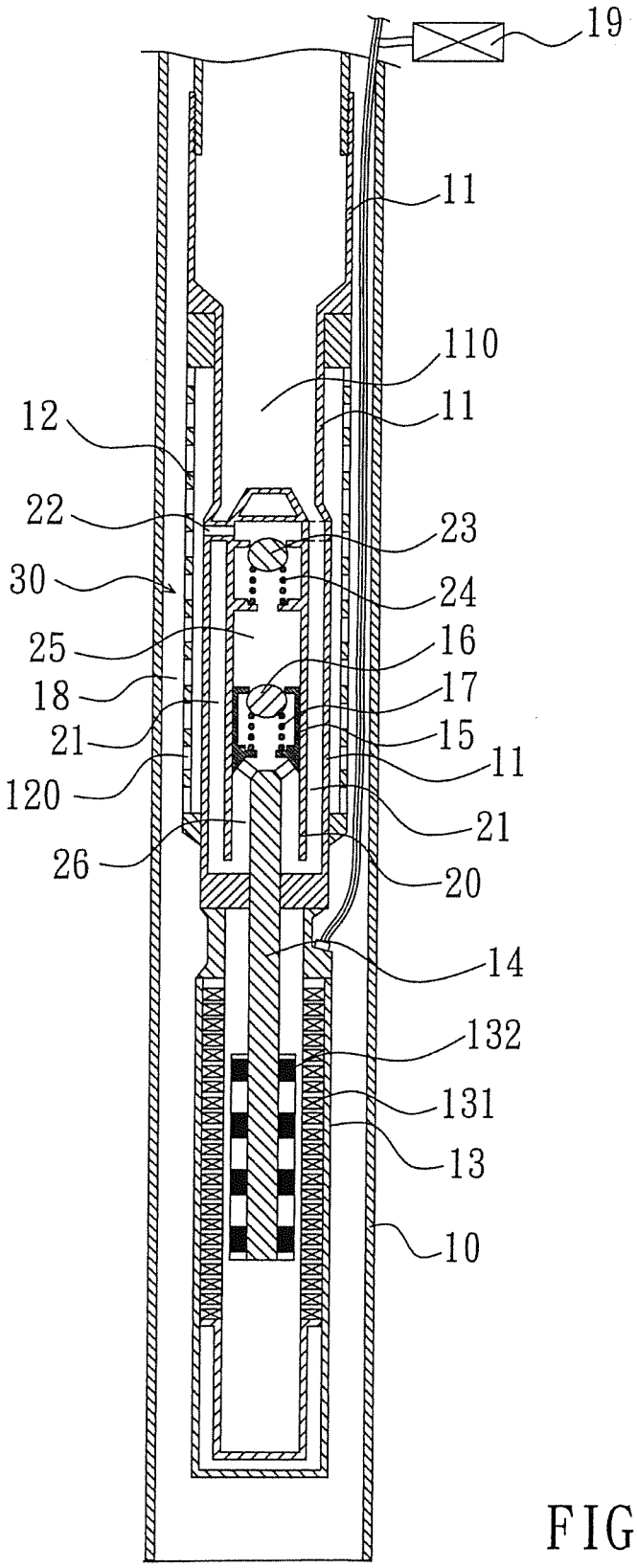
FIG. 1 is a sectional view of crude oil production equipment in accordance with the present invention.
Figure 2:
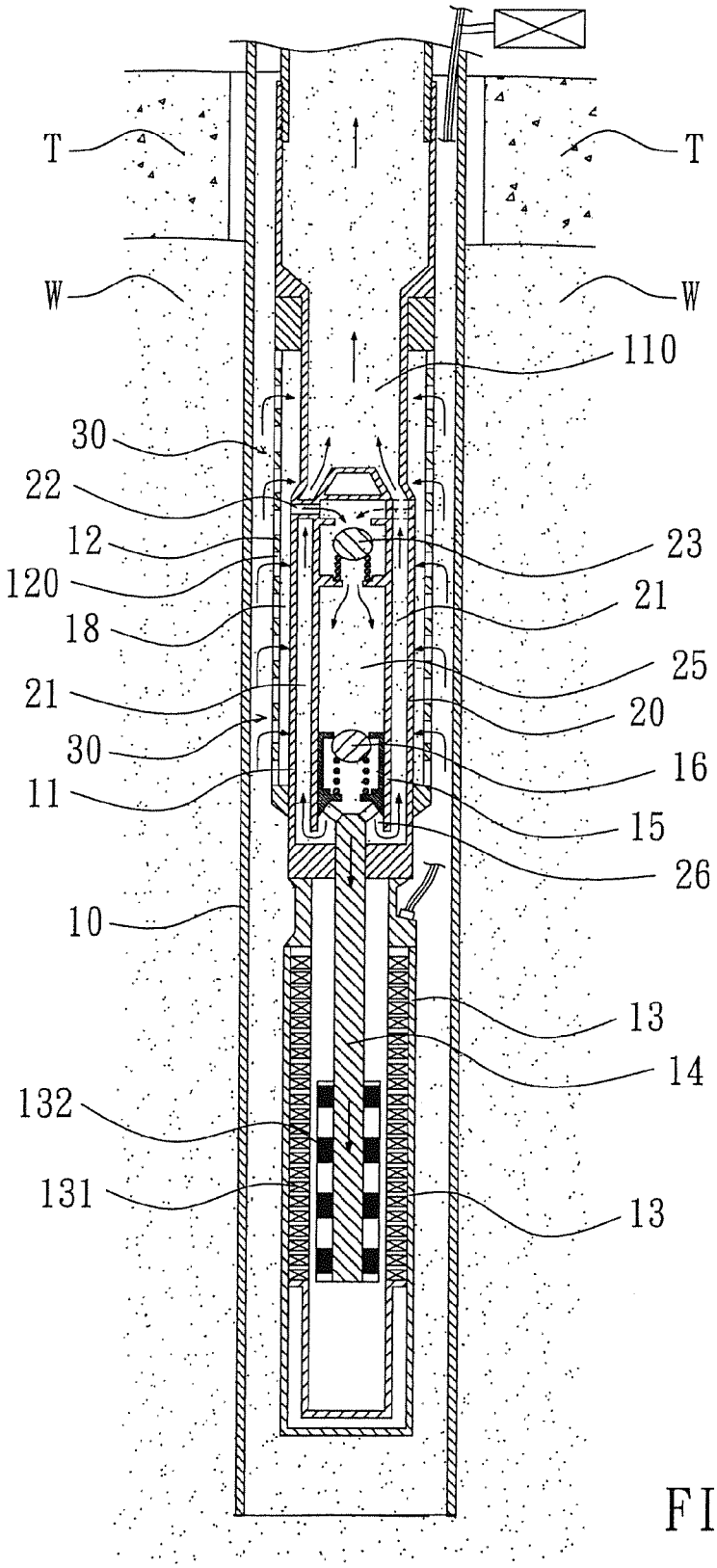
FIG. 2 is a schematic drawing illustrating an operation status of the present invention during down stroke of the driving shaft.
Figure 3:
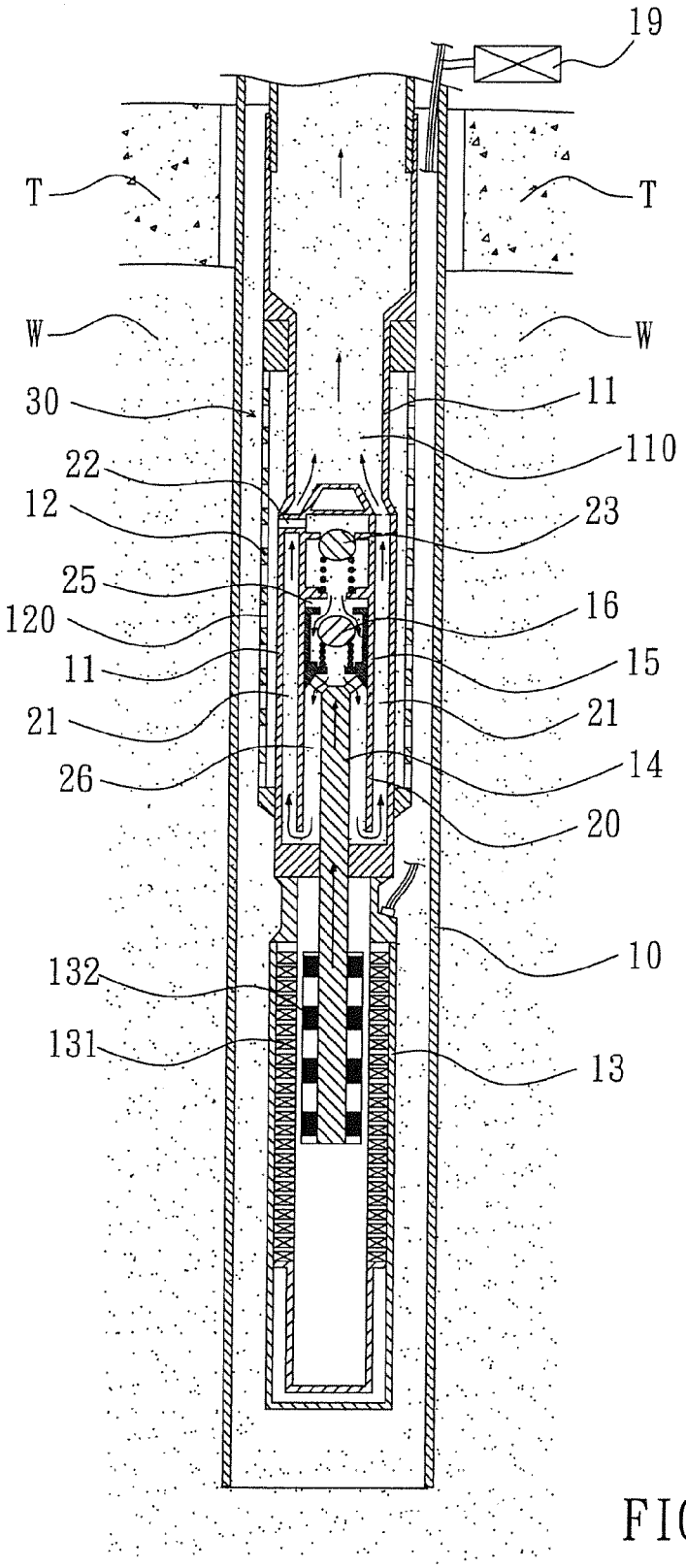
FIG. 3 is a schematic drawing illustrating an operation status of the present invention during up stroke of the driving shaft.

Referring to FIGS. 1-3, crude oil production equipment in accordance with the present invention is shown comprising a submersible pump 30, a driving shaft 14 mounted in the bottom side of the submersible pump 30, a linear motor 13 consisting of a stator 131 and a rotor 132 and adapted for moving the driving shaft up and down, an oil pipe 11 for output of crude oil, a well casing 10 surrounding the submersible pump 30 and the oil pipe 11, a filter pipe 12 surrounding the oil pipe 11 within the well casing 10 and having perforations 120 for delivering sands and mud out of the submersible pump 30, an outer passage 18 defined in between the filter pipe 12 and the oil pipe 11, an inner tube 20 mounted in the bottom side of the oil pipe 11, an oil inlet 22 defined in the top end of the inner tube 20 in communication with the outer passage 18, an upper valve ball 23 mounted in the top end of the inner tube 20 and adapted for closing the oil inlet 22, a spring 24 mounted in the top end of the inner tube 20 and supporting the upper valve ball 23 in the close position to close the oil inlet 22, a hollow piston 15 mounted in the inner tube 20 and dividing the inside space of the inner tube 20 into an upper chamber 25 and a lower chamber 26, a lower valve ball 16 supported on a spring 17 in the bottom side of the hollow piston 15 and adapted for closing the hollow piston 15, and a temperature sensor 19 electrically connected with the linear motor 13 for sensing the temperature of the linear motor 13.

The operation of the crude oil production equipment is outlined hereinafter. When the linear motor 13 is started up after positioning of the crude oil production equipment in the crude oil well W under the ground T, the rotor 132 moves the driving shaft 14 up and down. When the driving shaft 14 moves downwards, the lower valve ball 16 in the hollow piston 15 inside the inner tube 20 is moved to the close position, enabling crude oil to be forced out of the lower chamber 26 of the inner tube 20 into the inner passage 21 and toward the oil output 110 of the oil pipe 11, and at the same time, the upper valve ball 23 is moved to the open position, enabling the suction force produced due to down stroke of the hollow piston 15 to suck crude oil in the well casing 10 through the perforations 120 of the filter pipe 12 into the outer passage 18 and then through the oil inlet 22 into upper chamber 25 of the inner tube 20. When the rotor 132 moves the driving shaft 14 and the hollow piston 15 upwards, as shown in FIG. 3, the lower valve ball 16 in the hollow piston 15 inside the inner tube 20 is moved to the open position and the upper valve ball 23 is moved to the close position, enabling crude oil to flow out of the upper chamber 25 through the hollow piston 15 into the lower chamber 26, and at the same time, the driving shaft 14 enters the upper chamber 25 and the lower chamber 26, and the crude oil in the lower chamber 26 is forced into the inner passage 21 and then out of the oil outlet 110 of the oil pipe 10. Therefore, crude oil is pumped out of the oil outlet 110 of the oil pipe 10 either during up stroke or down stroke of the driving shaft 14, enhancing oil production efficiency. Further, the functioning of the filter pipe 12 prohibits mud and sands from entering the inner tube 20 and the oil pipe 11 to clog the outer and inner passages 18; 21 or to damage the hollow piston 15.

Further, the temperature sensor 19 is a resistance temperature sensor for sensing the resistance of the resistance value of the stator 131 and converting the detected resistance value into a temperature value. When the detected temperature is excessively high, the elevation of the crude oil production equipment in the oil well may have to be adjusted, or a certain problem occurs and must be eliminated.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. Crude oil production equipment, comprising a submersible pump, a driving shaft mounted in a bottom side of said submersible pump, a linear motor consisting of a stator and a rotor and adapted for moving said driving shaft up and down, an oil pipe for output of crude oil, a well casing surrounding said submersible pump and said oil pipe, a filter pipe surrounding said oil pipe within said well casing and having perforations for preventing the flow of sand and mud into said submersible pump, an outer passage defined in between said filter pipe and said oil pipe, an inner tube mounted in a bottom side of said oil pipe, an oil inlet defined in a top end of said inner tube in communication with said outer passage, an upper valve ball mounted in the top end of said inner tube and adapted for closing said oil inlet, a spring mounted in the top end of said inner tube and supporting said upper valve ball in a closed position to close said oil inlet, a hollow piston mounted in said inner tube and dividing the inside space of said inner tube into an upper chamber and a lower chamber, and a lower valve ball supported on a spring in a bottom side of said hollow piston and adapted for closing said hollow piston;

wherein when said driving shaft is moved downwards by said linear motor, a suction force is produced to suck crude oil from said well casing into said outer passage and said upper chamber of said inner tube via said oil inlet and said hollow piston forces crude oil out of said lower chamber into an inner passage and then said outlet; when said driving shaft is moved upwards by said linear motor, said hollow piston forces crude oil out of said upper chamber into said lower chamber, and said driving shaft enters said upper chamber and said lower chamber to force crude oil out of said lower chamber into said inner passage and said oil outlet.

2. The crude oil production equipment as claimed in claim 1, further comprising a temperature sensor electrically connected with said linear motor for sensing the temperature of said linear motor.

* * * * *